US006132237A

United States Patent [19]

Hwang

[11] Patent Number: 6,132,237

[45] Date of Patent: Oct. 17, 2000

[54] IDC CONTACT WITH ARCUATE TERMINATING MEANS FOR THIN WIRE

[75] Inventor: Jenq-Yih Hwang, Irvine, Calif.

[73] Assignee: Hon Hai Precision Ind. Co., Ltd., Taipei Hsien, Taiwan

[21] Appl. No.: 09/368,638

[22] Filed: Aug. 4, 1999

[51] Int. Cl.[7] ..... H01R 43/16

[52] U.S. Cl. ..... 439/395; 29/874

[58] Field of Search ..... 439/395–408; 29/874, 882

[56] References Cited

U.S. PATENT DOCUMENTS

| | | | |
|---|---|---|---|
| 3,937,549 | 2/1976 | Hughes | 439/395 |
| 4,591,223 | 5/1986 | Vachhani | 439/396 |
| 5,616,047 | 4/1997 | Lutsch | 439/395 |
| 5,759,061 | 6/1998 | Jensen et al. | 439/400 |

FOREIGN PATENT DOCUMENTS

| | | | |
|---|---|---|---|
| 3913842 | 10/1990 | Germany | 439/395 |

*Primary Examiner*—Gary F. Paumen
*Attorney, Agent, or Firm*—Wei Te Chung

[57] ABSTRACT

An insulation displacement contact (IDC) includes a contact body and a pair of opposing blades extending from the body. The blades have edges spaced from and facing each other thereby defining a slot having a first width therebetween for receiving a wire. The edge of each blade forms an arcuate convex portion defining a gap of a second width therebetween. The second width is smaller than the first width thereby being capable of connecting with a wire of a smaller diameter. The convex portions of the blades may be formed by coining. A method for making the IDC contact is also disclosed. The method includes the steps of: (1) providing an IDC contact by punching or equivalent mechanical forming processes, the IDC contact having a contact body and a pair of opposing blades extending therefrom, the blades having edges facing and spaced from each other thereby defining a slot of a first width therebetween for receiving a wire, and (2) forming an arcuate convex portion on the edge of each blade by coining, the convex portions facing each other and defining a gap of a second width therebetween, the second width being smaller than the first width.

6 Claims, 4 Drawing Sheets

IDC CONTACT WITH ARCUATE TERMINATING MEANS FOR THIN WIRE

BACKGROUND OF THE INVENTION

1. Field of the Invention

The present invention generally relates to an insulation displacement contact (IDC), and in particular to an IDC contact having arcuate terminating means for a thin wire.

2. The Prior Art

Insulation displacement contact (IDC) techniques are widely used for efficiently and simultaneously connecting a number of wires to a corresponding number of contacts of an electrical connector. As shown in FIG. 1 of the attached drawings, an IDC contact 10 comprises a pair of spaced blades 12 having opposing edges 14. A slot 16 of a predetermined width is defined between the edges 14. The slot 16 has a diverging opening 18 for facilitating insertion of a wire 20 of a corresponding gauge. The wire 20 comprises a core conductor 22 enclosed by an insulative coating 24.

As shown in FIG. 2, the wire 20 is forcibly inserted into the slot 16 of the IDC contact 10 causing the insulative coating 24 thereof to be pierced by the edges 14 of the blades 12 thereby forming electrical engagement between the blades 12 and the core conductor 22.

To ensure proper engagement between the blades 12 and the core conductor 22, the width of the slot 16 must precisely correspond to the gauge of the wire 20. For example, a 30 AWG (American Wire Gauge) wire requires a gap of 0.15 mm between the blades 12. The slot 16 may only have a width of 0.10 mm for a 32 AWG wire. Such a small width complicates manufacture of the IDC contact by punching whereby the punching die has a corresponding small dimension that is incapable of sustaining a large punching force and may be damaged during the punching operation.

It is thus desired to provide an improved IDC contact structure for overcoming the above problem.

SUMMARY OF THE INVENTION

Accordingly, an object of the present invention is to provide an IDC contact made by punching for connecting large gauge wires.

Another object of the present invention is to provide a method for making such an IDC contact.

To achieve the above objects, an IDC contact in accordance with the present invention comprises a contact body with a pair of opposing blades extending therefrom. The blades have edges spaced from and facing each other thereby defining a slot having a first width therebetween for receiving a wire. The edge of each blade forms an arcuate convex portion defining a gap of a second width therebetween. The second width is smaller than the first width thereby being capable of connecting with a wire of a smaller diameter. The convex portions of the blades may be formed by coining. A method for making the IDC contact is also disclosed. The method comprises the steps of: (1) providing an IDC contact by punching or equivalent mechanical forming processes, the IDC contact having a contact body and a pair of opposing blades extending therefrom, the blades having edges facing and spaced from each other thereby defining a slot of a first width therebetween for receiving a wire, and (2) forming an arcuate convex portion on the edge of each blade by coining, the convex portions facing each other and defining a gap of a second width therebetween, the second width being smaller than the first width.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
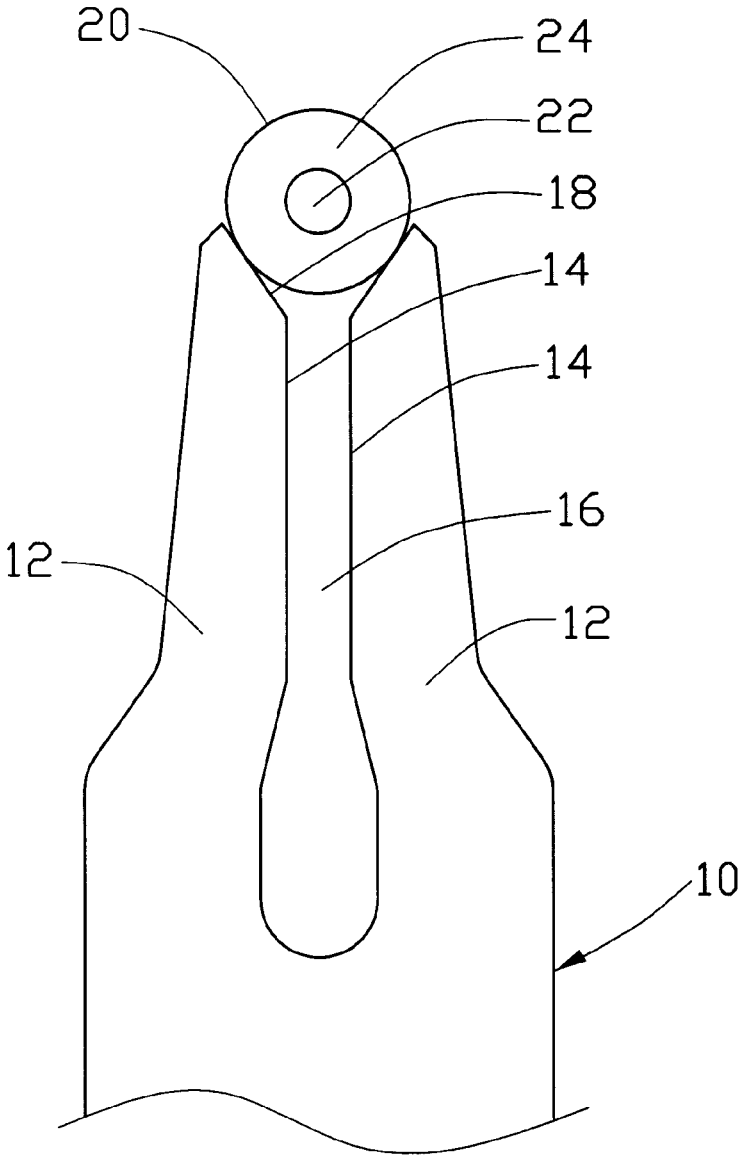
FIG.1 (PRIOR ART)
FIG. 1 is a plan view of a portion of a conventional IDC contact and a wire to be connected thereto.
Figure 2:
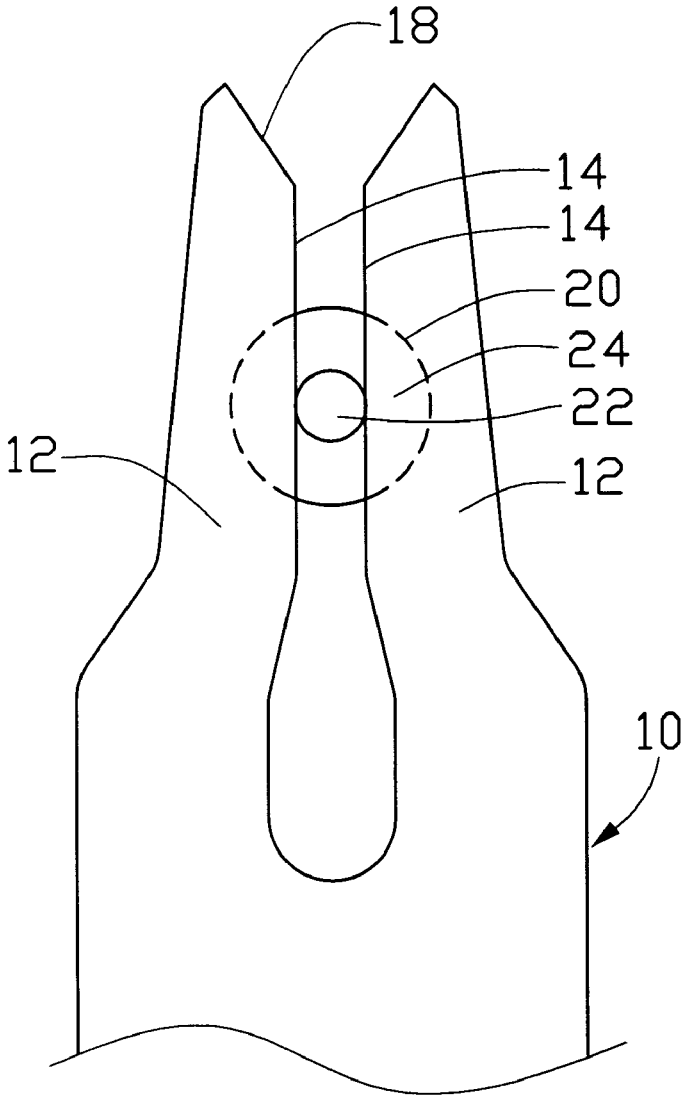
FIG.2 (PRIOR ART)
FIG. 2 is similar to FIG. 1 but showing the wire connected to the conventional IDC contact.
Figure 3:
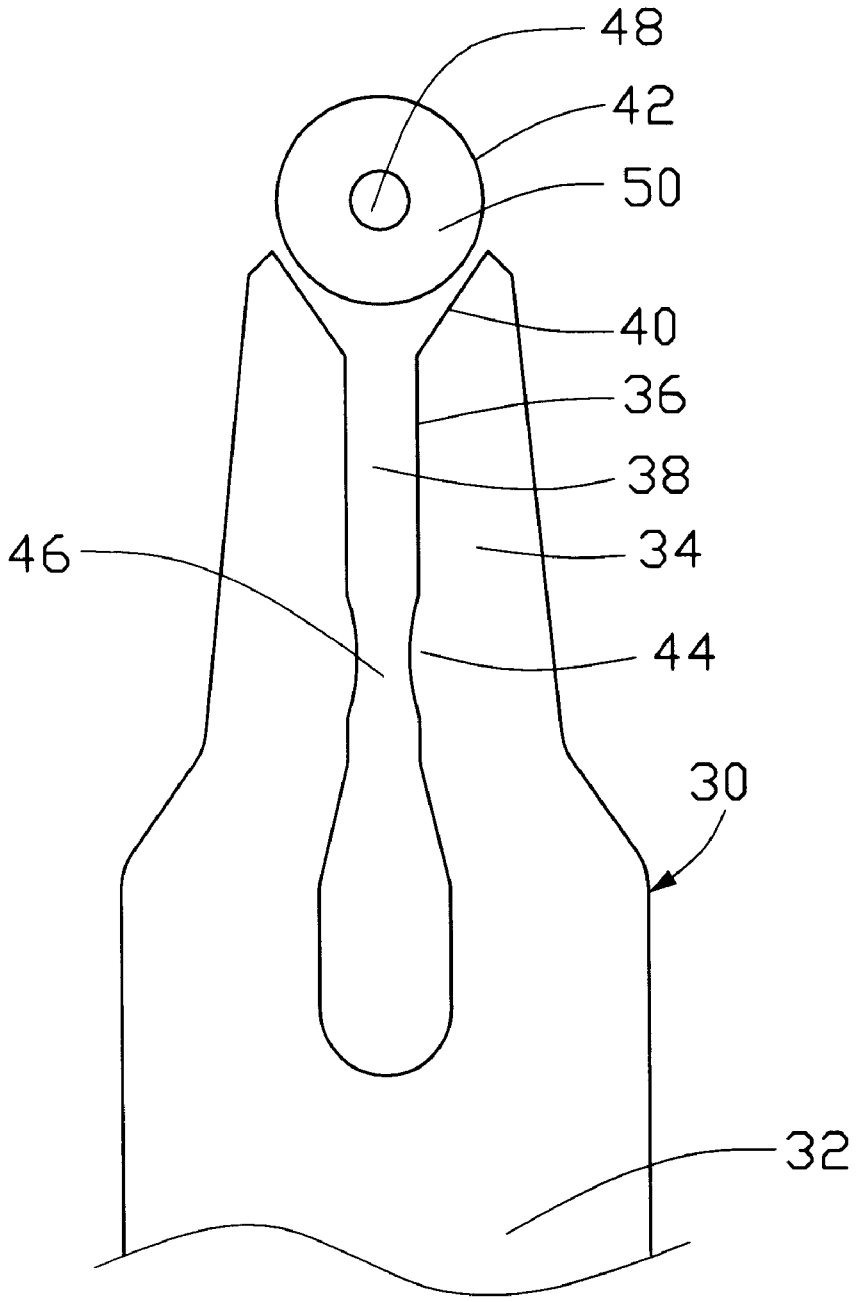
FIG. 3 is a plan view of a portion of an IDC contact constructed in accordance with the present invention and a wire to be connected thereto.

Referring to the drawings and in particular to FIG. 3, an insulation displacement contact (IDC) 30 constructed in accordance with the present invention comprises a contact body 32 and a pair of opposing blades 34 extending from the contact body 32. The blades 34 have edges 36 facing and spaced from each other thereby defining a slot 38 having a first width therebetween. The slot 38 has a diverging opening 40 for facilitating insertion of a wire 42 therein.

The edge 36 of each blade 34 forms an arcuate convex portion 44. The convex portions 44 oppose each other and define a gap 46 of a second width therebetween. The second width is smaller than the first width.

Figure 4:
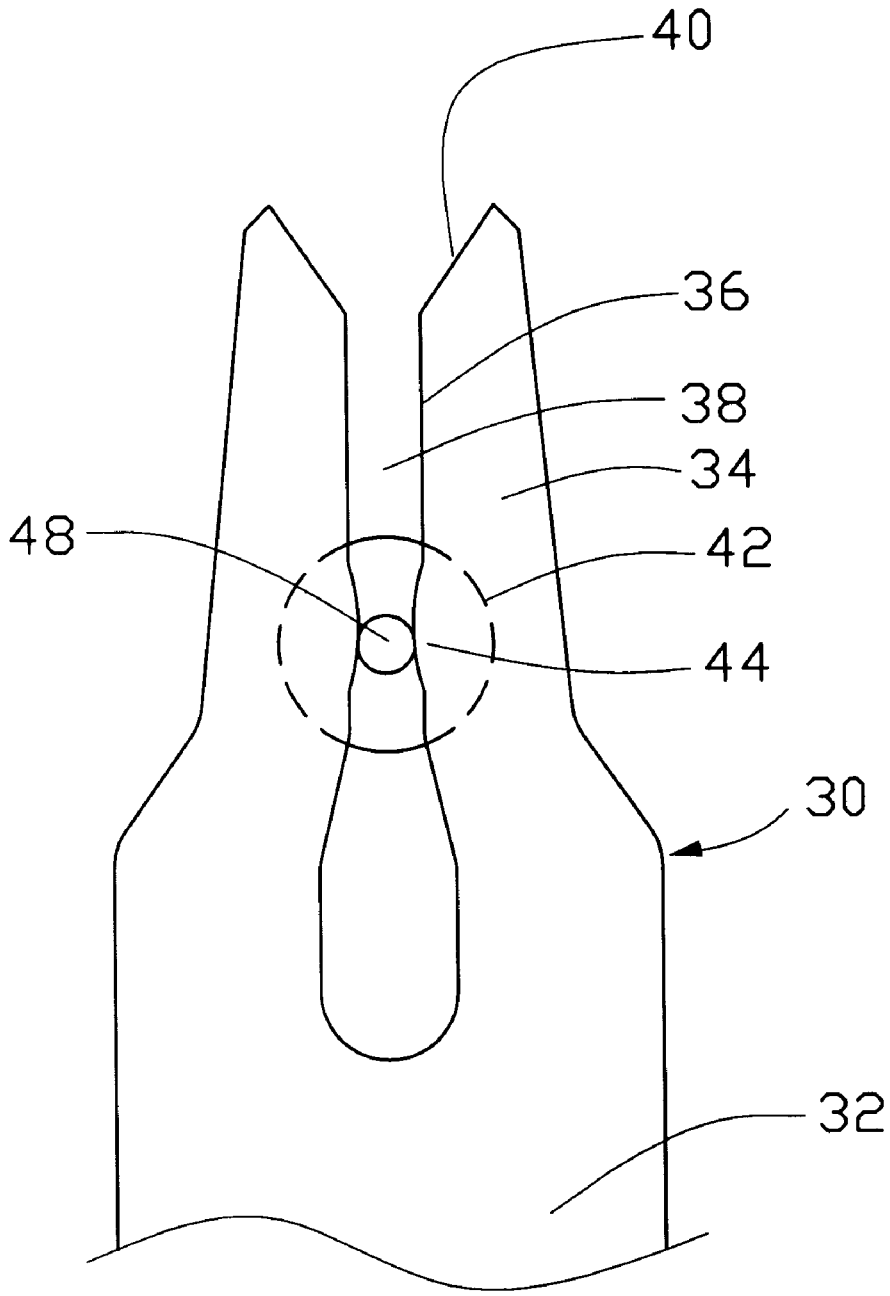
FIG. 4 is similar to FIG. 3 but showing the wire connected to the IDC contact of the present invention.

The wire 42 to be inserted into the IDC contact 30 comprises a core conductor 48 enclosed by an insulative coating 50. The core conductor 48 has a diameter smaller than the first width of the slot 38 between the blades 34 and substantially corresponds to or is slightly larger than the second width of the gap 46 between the convex portions 44. As shown in FIG. 4, when the wire 42 is forcibly inserted into the gap 46 through the slot 38, the insulative coating 50 thereof is pierced by the convex portions 44 of the blades 34 and electrical engagement is formed between the convex portions 44 and the core conductor 48.

The wire 42 can be a 32 AWG wire, while the second width of the gap 46 between the convex portions 44 can be 0.10 mm. The first width may be substantially 0.15 mm corresponding to a 30 AWG wire.

The IDC contact 30 of the present invention may be formed by punching a metal blank. The slot 38 is uniformly formed between the blades 34. A coining operation is then performed on the edges 36 of the blades 34 to form the convex portions 44. In this way, the IDC contact 30 may be formed without risk of damage to a die.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A method for manufacturing an insulation displacement contact comprising the following steps:

(a) forming a contact having a contact body and a pair of opposing blades integrally formed with each other in a coplanar manner, the blades having edges facing and spaced from each other for defining therebetween a slot having a first width; and (b) coining a convex portion on the edge of each blade, the convex portions facing and being spaced from each other for defining therebetween a gap, the gap having a second width which is smaller than the first width.

2. The method as claimed in claim 1, wherein the contact is formed by punching.

3. The method as claimed in claim 1, wherein the second width is 0.10 mm and is adapted to connect a 32 AWG wire.

4. The method as claimed in claim 3, wherein the first width is 0.15 mm and is sufficient to connect a wire having a gauge less than 32 AWG.

5. The method as claimed in claim 1, wherein the convex portions are arcuate.

6. The method as claimed in claim 1, wherein the slot between the blades has a diverging opening.

* * * * *